US007726530B1

(12) United States Patent
Exposito

(10) Patent No.: US 7,726,530 B1
(45) Date of Patent: Jun. 1, 2010

(54) ERGONOMIC BACKPACK

(76) Inventor: Amaro Manuel Exposito, 8492 SW. 8th St., Miami, FL (US) 33144

( * ) Notice: Subject to any disclaimer, the term of this patent is extended or adjusted under 35 U.S.C. 154(b) by 1019 days.

(21) Appl. No.: 11/432,174

(22) Filed: May 12, 2006

(51) Int. Cl.
*A45F 3/00* (2006.01)

(52) U.S. Cl. ..... 224/630; 224/632; 224/635; 224/628

(58) Field of Classification Search ..... 224/630, 224/632, 635, 653, 657, 628
See application file for complete search history.

(56) References Cited

U.S. PATENT DOCUMENTS 4,479,595 A * 10/1984 Opsal ..... 224/630
5,209,384 A * 5/1993 Anderson ..... 224/580
5,361,955 A * 11/1994 Gregory ..... 224/630
6,095,389 A * 8/2000 Fenton et al. ..... 224/627
6,626,341 B2 * 9/2003 Mitchell ..... 224/576
6,626,342 B1 * 9/2003 Gleason ..... 224/633

* cited by examiner

*Primary Examiner*—Nathan J Newhouse
*Assistant Examiner*—Lester L Vanterpool
(74) *Attorney, Agent, or Firm*—Albert Bordas, P.A.

(57) ABSTRACT

An ergonomic backpack that comprises a main compartment, an elongated longitudinal curved-shaped back support, padding, and a strap assembly. The main compartment defines a substantially hollow first cavity. The elongated longitudinal curved-shaped back support has curvature areas. One curvature area complements and supports a thoracic vertebrae of a human vertebral column, and the other curvature area complements and supports a lumbar vertebrae. The padding comprises dorsal padding and lumbar padding. The dorsal padding and the lumbar padding are of a sufficient predetermined thickness to dispense pressure upon the human vertebral column. The pressure results from a force established by a weight of matter housed within the first cavity, or otherwise secured upon the main compartment. The strap assembly is fixedly secured to the main compartment and comprises shoulder straps, chest straps, and waist straps. The strap assembly also dispenses the pressure resulting from the force described above.

11 Claims, 5 Drawing Sheets

ERGONOMIC BACKPACK

BACKGROUND OF THE INVENTION

1. Field of the Invention

The present invention relates to carrying aides, and more particularly, to ergonomic backpacks.

2. Description of the Related Art

The human vertebral column, also called the backbone, spine, or spinal column, consists of a series of thirty-three irregularly shaped bones, called vertebrae. These thirty-three bones are divided into five categories depending on where they are located in the backbone.

The first seven vertebrae are called the cervical vertebrae. Located at the top of the spinal column, these bones form a flexible framework for the neck and support the head. The next twelve vertebrae are called the thoracic vertebrae. These bones move with the ribs to form the rear anchor of the rib cage. Thoracic vertebrae are larger than cervical vertebrae and increase in size from top to bottom. After the thoracic vertebrae, come the lumbar vertebrae. These five bones are the largest vertebrae in the spinal column. These vertebrae support most of the body's weight and are attached to many of the back muscles. The sacrum is a triangular bone located just below the lumbar vertebrae. It consists of four or five sacral vertebrae in a child, which becomes fused into a single bone approximately after age twenty-six. The sacrum forms the back wall of the pelvic girdle and moves with it. The bottom of the spinal column is called the coccyx or tailbone. It consists of three to five bones that are fused together in an adult.

These bones compose the vertebral column, resulting in a total of twenty-six movable parts in an adult. In between the vertebrae are intervertebral discs made of fibrous cartilage that act as shock absorbers and allow the back to move.

When looked at from the side, the spine forms four curves. These curves are called the cervical, thoracic, lumbar, and pelvic curves. The cervical curve is located at the top of the spine and is composed of cervical vertebrae. Next come the thoracic and lumbar curves composed of thoracic and lumbar vertebrae respectively. The final curve called the pelvic or sacral curve is formed by the sacrum and coccyx. These curves allow human beings to stand upright and help to maintain the balance of the upper body. The cervical and lumbar curves are not present in an infant. The cervical curve forms around the age of three months when an infant begins to hold its head up and the lumbar curve typically develops when a child begins to walk.

In addition to allowing humans to stand upright and maintain their balance, the vertebral column serves several other important functions. It helps to support the head and arms, while permitting freedom of movement. It also provides attachment for many muscles, the ribs, and some of the organs and protects the spinal cord, which controls most bodily functions.

During adolescent years it is common for stress to be exerted upon the vertebral column when adolescents carry backpacks. Stress exerted upon the vertebral column, and the skeletal and muscular system in general, is the main cause of back pain, muscular spasms, and structural misalignments of the human's vertebral column and skeletal system in general. Non-equilibrated backpacks are one of the most common causes of such stress, resulting in health problems for life.

Several designs for backpacks have been designed in the past. None of them, however, comprise the innovative subject matter provided in the specifications below.

SUMMARY OF THE INVENTION

The instant invention comprises a combination longitudinal curved-shaped back support, with a plurality of padding at predetermined positions, that alleviate pressures upon the back of a user while bearing a load of matter carried within a backpack. Additionally, two shoulder straps mounted to a rear wall include gel supports to disperse pressure over the shoulders and neck area of the user. One chest strap is fixed to each of the shoulder straps that may be adjusted to the center of the chest, therefore placing the weight of the backpack at the center of the body to relieve direct pressure to the user's vertebral column.

More specifically, the instant invention is an ergonomic backpack that comprises a main compartment. The main compartment has at least one access wall that has a first substantially inverted U shape, a rear wall and a base wall to define a substantially hollow first cavity. The access wall has a first zipper as a means to access the first cavity. An elongated longitudinal curved-shaped back support is interiorly mounted within the rear wall and has curvature areas in between first and second ends. One curvature area complements and supports thoracic vertebrae of a human vertebral column, and the other curvature area complements and supports a lumbar vertebrae of the human vertebral column. A pad comprises dorsal padding and lumbar padding that outwardly protrude from the rear wall of the main compartment. The dorsal padding and the lumbar padding are ergonomically designed to contour the back and shoulders of a human. The dorsal padding and the lumbar padding are of a sufficient predetermined thickness to dispense pressure upon the human vertebral column. The pressure results from a force established by a weight of matter housed within the first cavity, or otherwise secured upon the main compartment. A strap assembly is fixedly secured to the main compartment and comprises shoulder straps, chest straps, and waist straps. The shoulder straps also include padding that dispenses the pressure resulting from the force defined above. The shoulder straps have the chest straps fixed thereon. The chest straps may be adjusted to a center chest of the human to align the main compartment with the human vertebral column. The chest straps have first cooperative locking means to adjustably mount thereon and to fixedly secure the chest straps around the center chest of the human. The waist straps have second cooperative locking means adjustably mounted thereon to fixedly secure around a waist of the human. The strap assembly also dispenses the pressure resulting from the force described above.

The elongated longitudinal curved-shaped back support defines a first predetermined displacement distance from the curvature area to a first vertical plane defined from the curvature area, and defines a second predetermined displacement distance from the curvature area to a second vertical plane defined from the curvature area. The first predetermined displacement distance is in a range of between 15 cm and 19 cm, and the second predetermined displacement distance is in a range of between 17 cm and 21 cm. In the preferred embodiment, the first predetermined displacement distance and the second predetermined displacement distance is in a range of between 17 cm and 19 cm. The base wall has a substantially rectangular shape and may include a semi-rigid material to serve as a structural base. The elongated longitudinal curved-shaped back support is made of a rigid material, such as plastic or PVC and covered with a soft padding-type material. The pad is made out of a soft material such as foam or a similar type material having foam-like characteristics.

The ergonomic backpack may also comprise a micro massage system having massage units, an operating switch, and a battery source. The ergonomic backpack may also comprise a forward compartment forwardly extending from the main compartment. The forward compartment comprises an access wall that has a second substantially inverted U shape and a front wall to define a substantially hollow second cavity. This access wall has a second zipper as a means to access the second cavity. The ergonomic backpack may also comprise an accessory compartment forwardly extending from the forward compartment. The accessory compartment comprises an access wall that has a third substantially inverted U shape and a front wall to define a substantially hollow third cavity. This access wall has a third zipper as a means to access the third cavity.

It is therefore one of the main objects of the present invention to provide an ergonomic backpack that distributes the weight of its contents to relieve stress exerted upon the vertebral column, while promoting equilibrium of the muscular structure and especially the vertebral column of the user.

It is another object of this invention to provide an ergonomic backpack that includes a combination longitudinal curved-shaped back support, with a plurality of padding at predetermined positions, that alleviate pressures upon the back of the user while bearing a load of matter carried within the backpack.

It is another object of the present invention to provide an ergonomic backpack that also includes two shoulder straps having gel supports to disperse pressure over the shoulders and neck area of the user.

It is another object of the present invention to provide an ergonomic backpack that additionally includes at least one chest strap fixed to each shoulder strap and may be adjusted to the center of the user's chest, to place the weight of the backpack to the center of the body and to relieve direct pressure to the user's spine.

It is yet another object of this invention to provide such an ergonomic backpack that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
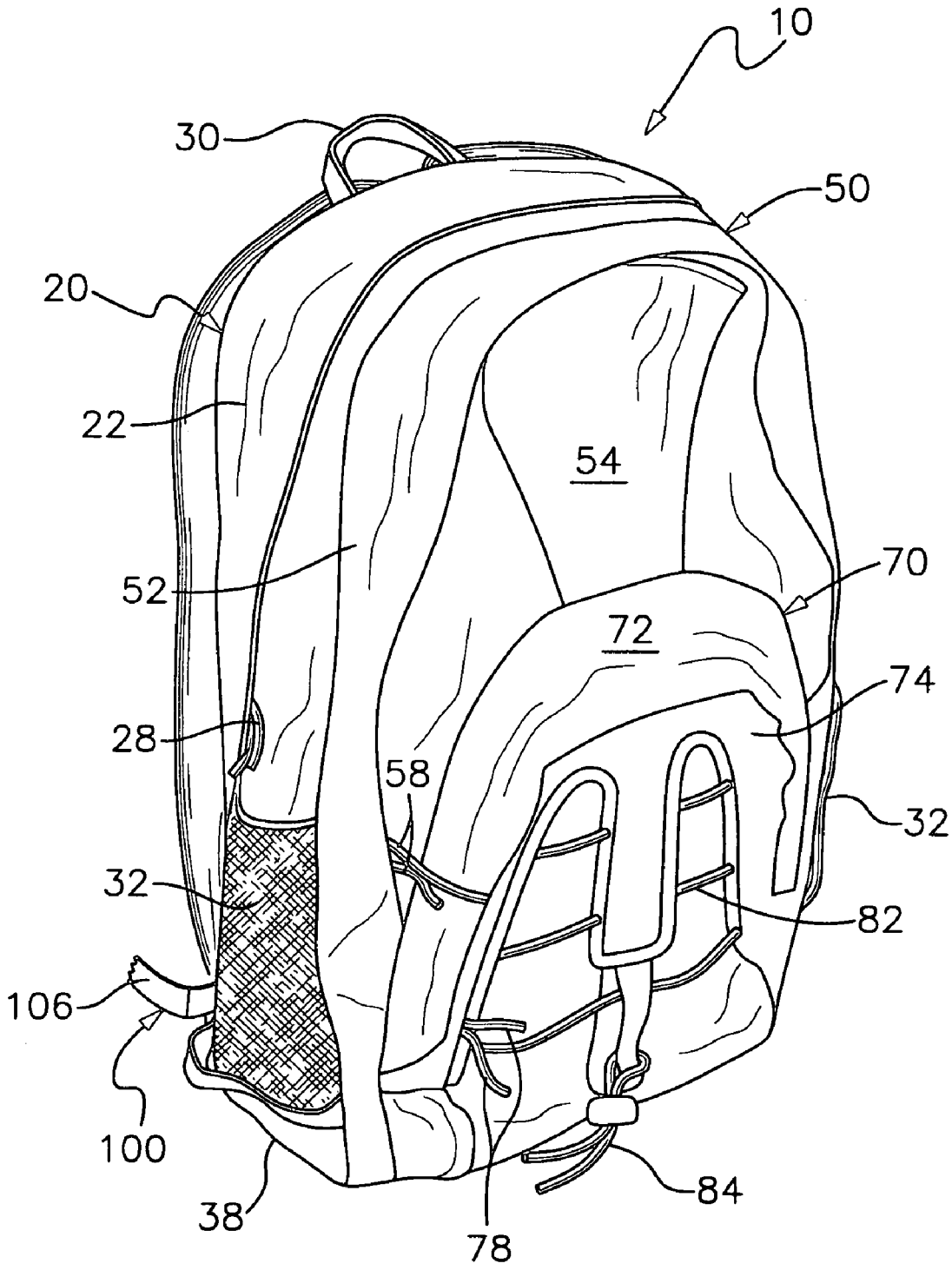
FIG. 1 represents an isometric view of the ergonomic backpack, object of the present application.

Referring now to the drawings, the ergonomic backpack, object of the present application is generally referred to with numeral 10. It can be observed that it basically includes main compartment 20, elongated longitudinal curved-shaped back support 60, padding 90, and strap assembly 100.

As seen in FIG. 1, main compartment 20 comprises access wall 22 that has a substantially inverted U shape. Access wall 22 has zipper 26, seen in FIG. 4, to access the interior of main compartment 20, defining a first cavity. Zipper strap 28 is attached to zipper 26 and is used to open and close zipper 26 as a means to access the first cavity. Attached onto access wall 22 are pockets 32. Pockets 32 have a predetermined shape and size to accommodate water bottles, cellular phones, and other items that fit within. Also attached to main compartment 20 is strap handle 30. Instant invention 10 may be optionally carried by a used at its strap handle 30.

Forwardly extending from main compartment 20 is forward compartment 50. Similarly to main compartment 20, forward compartment 50 comprises access wall 52 that has a substantially inverted U shape. Similarly to access wall 22, access wall 52 has a zipper, not seen, to access the interior of forward compartment 50, defining a second cavity. Zipper strap 58 is attached to the zipper, not seen, and is used to open and close the zipper as a means to access the second cavity. Forward compartment 50 also comprises an approximately perpendicularly disposed front wall 54 to further define this compartment.

Forwardly extending from forward compartment 50 is accessory compartment 70. Similarly to forward compartment 50, accessory compartment 70 comprises access wall 72 that has a substantially inverted U shape. Similarly to access wall 52, access wall 72 has a zipper, not seen, to access the interior of accessory compartment 70, defining a third cavity. Zipper strap 78 is attached to the zipper, not seen, and is used to open and close the zipper as a means to access the third cavity. Accessory compartment 70 also comprises an approximately perpendicularly disposed front wall 74 to further define this compartment. Attached onto front wall 74 are a plurality of elastic cords 82 and at least one elastic cord 84. Elastic cords 82 and at least one elastic cord 84 serve as ornamental features that also have utility to restrain items. Specifically, elastic cords 82 may hold items against front wall 74, and elastic cord 84 may be used to tie items thereon.

Instant invention 10 also comprises base wall 38 that has a substantially rectangular shape and may include a semi-rigid material to serve as a structural base.

Figure 2:
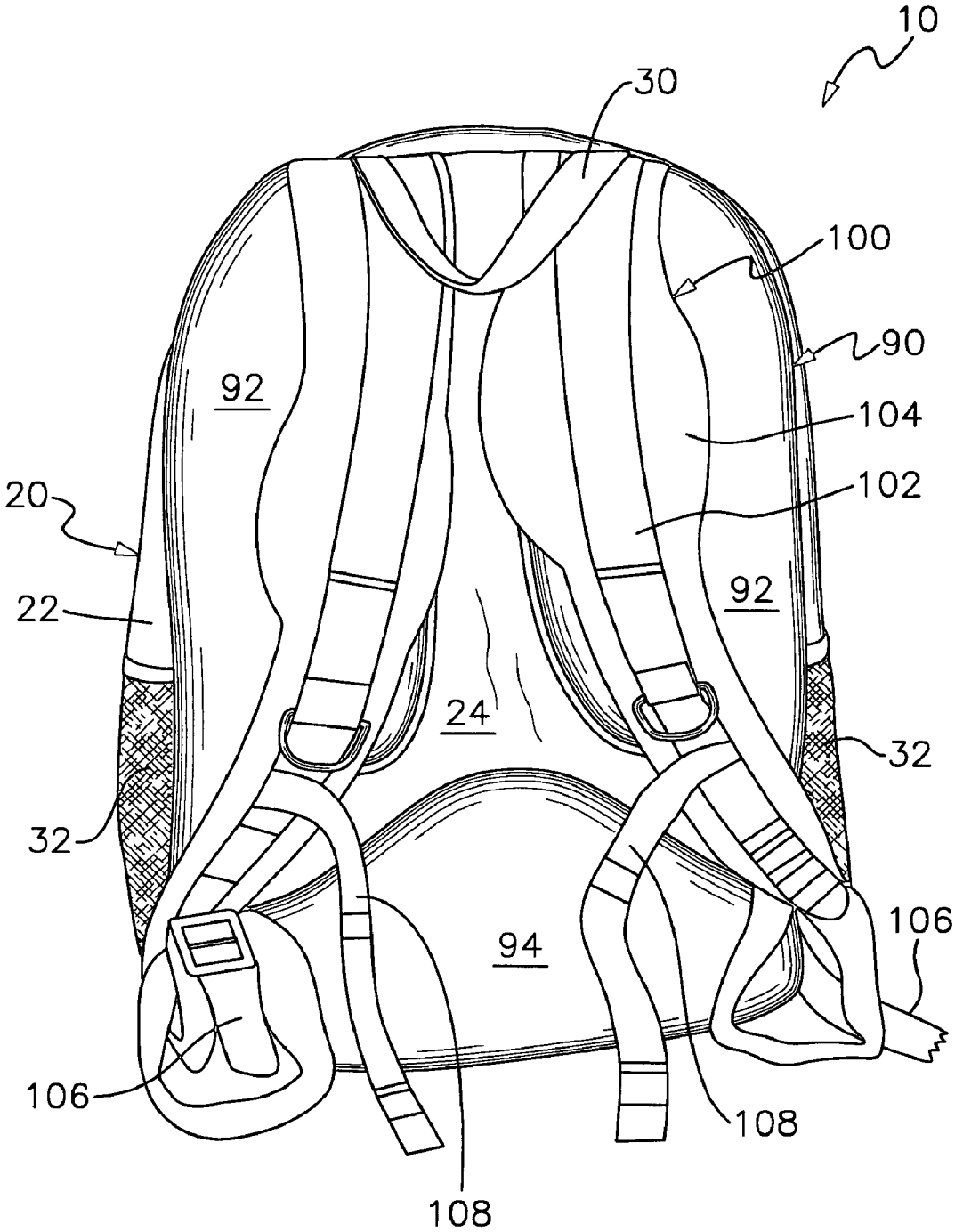
FIG. 2 shows a rear elevational view of the present invention.
Figure 3:
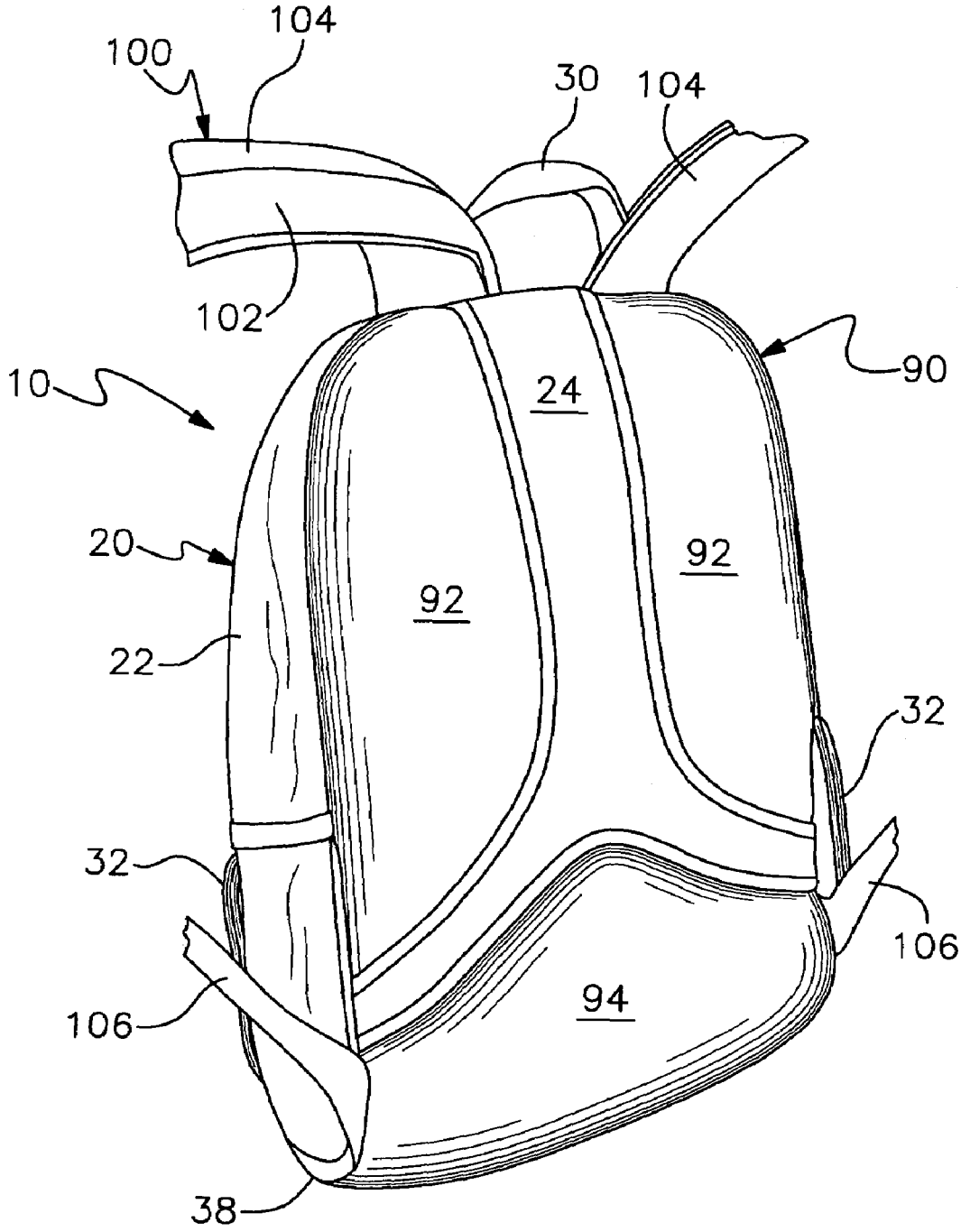
FIG. 3 illustrates an isometric view of the present invention, showing the shoulder straps lifted for a better view of the rear wall.

As best seen in FIGS. 2 and 3, instant invention 10 comprises padding 90 and strap assembly 100. Padding 90 comprises dorsal padding 92 and lumbar padding 94 that protrude from rear wall 24 of main compartment 20. Dorsal padding 92 and lumbar padding 94 are ergonomically designed to contour the shoulders and back of a user. In the preferred embodiment, padding 90 is made out of a soft material such as foam or a similar type material having foam-like characteristics. Furthermore, the dorsal padding 92 and lumbar padding 94 are of a sufficient predetermined thickness to relieve direct pressure to the spine of the user.

Strap assembly 100 comprises shoulder straps 102 having padding 104. In the preferred embodiment, padding 104 is defined as gel supports that disperse pressure over the shoulders and neck area of the user. Pressure is the result of the downward force established by the weight of matter housed within, or otherwise secured upon, instant invention 10. Shoulder straps 102 also include chest straps 108 fixed to the inner edges of shoulder straps 102. The chest straps 108 may be adjusted to the center of the chest of the user to place the weight of backpack 10 to the center of the user's body. Chest straps 108 have cooperative locking means adjustably mounted thereon to fixedly secure around the chest of the user. Strap assembly 100 also comprises waist straps 106. Waist straps 106 have cooperative locking means adjustably mounted thereon to fixedly secure around the waist of the user. Strap assembly 100 is intended to relieve direct pressure to the spine of the user.

Figure 4:
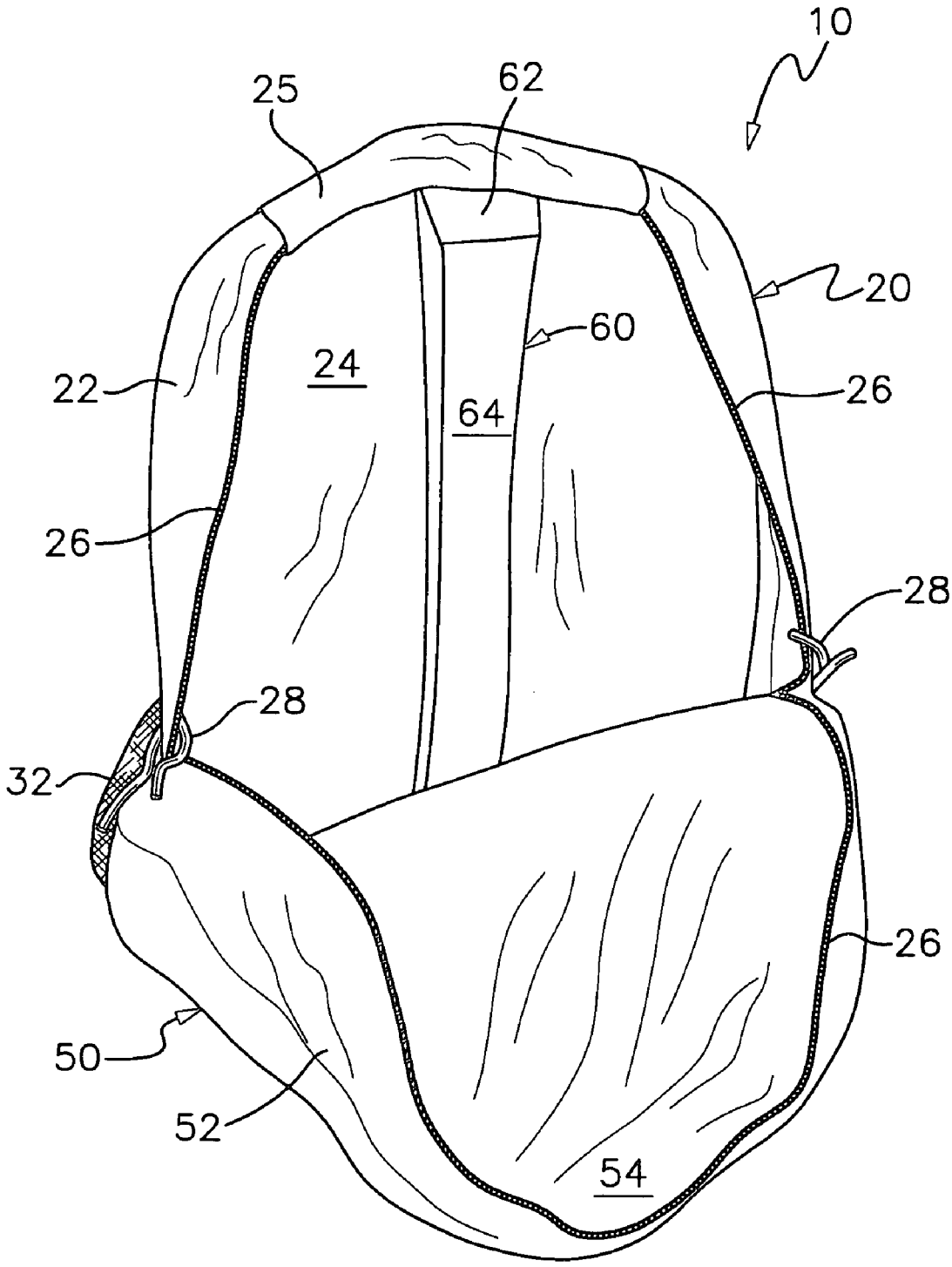
FIG. 4 is an isometric view of the ergonomic backpack with the main compartment in an open position, showing the interior portion of the rear wall and the longitudinal curved-shaped back support mounted therein.

As seen in FIG. 4, elongated longitudinal curved-shaped back support 60 is mounted upon rear wall 24. Elongated longitudinal curved-shaped back support 60 is made of a rigid material, such as plastic or PVC and covered with a soft padding-type material. Main compartment 20 also comprises cover wall 25 that serves as an interior liner to cover the interior side of rear wall 24 and elongated longitudinal curved-shaped back support 60.

Figure 5:
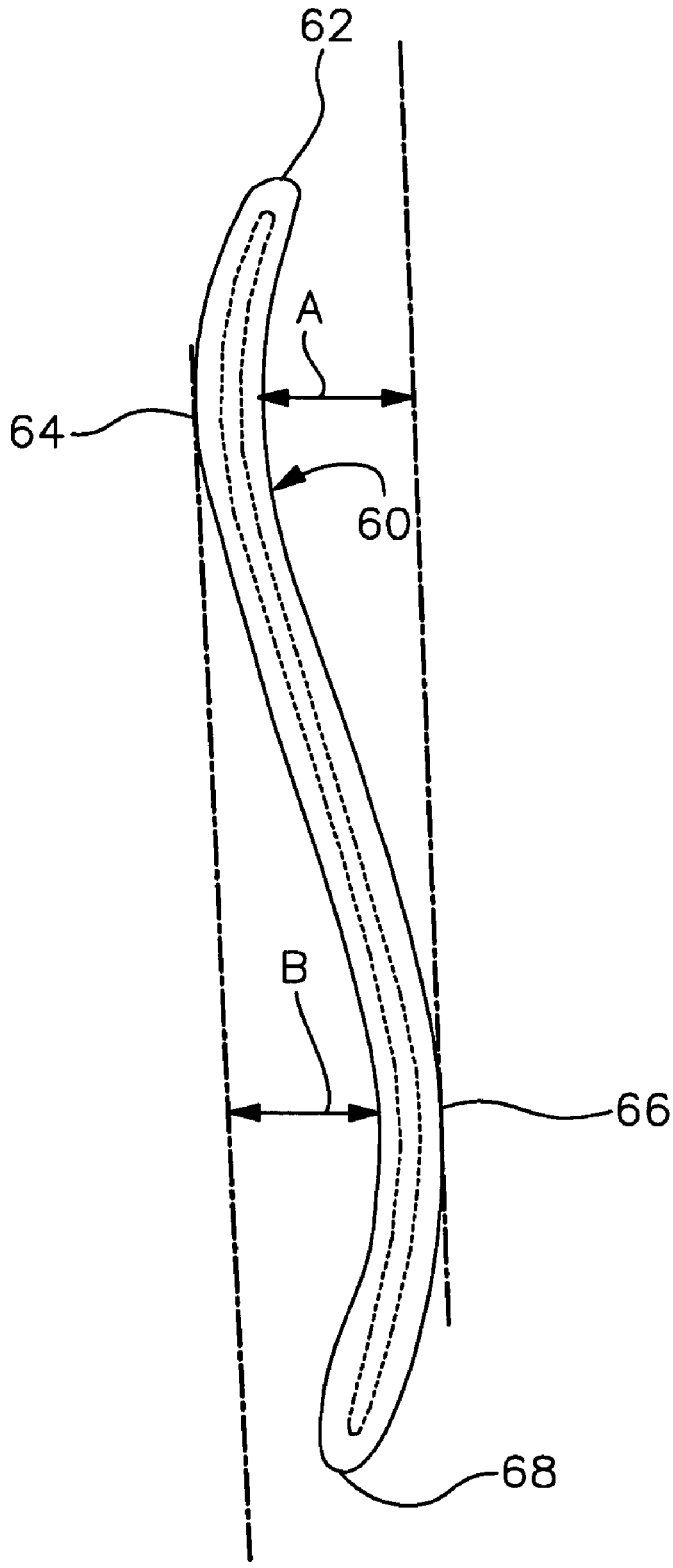
FIG. 5 is an isometric view of the longitudinal curved-shaped back support.

As best seen in FIG. 5, the elongated longitudinal curved-shaped back support 60 is in the form of an incomplete S-shape to complement the spine's curvature of a human. Elongated longitudinal curved-shaped back support 60 comprises curvature areas 64 and 66 in between ends 62 and 68. Curvature area 64 is defined as an upper curvature to complement the spine's upper curvature of a human, and curvature area 66 is defined as a lower curvature to complement the spine's lower curvature of a human.

As seen in this illustration, section "A" defines a displacement distance of curvature area 64 from a first vertical plane defined from curvature area 66; and section "B" defines a displacement distance of curvature area 66 from a second vertical plane defined from curvature area 64. In the preferred embodiment, the section "A" displacement distance is in a range of between 15 cm and 19 cm, and the section "B" displacement distance is in a range of between 17 cm and 21 cm; and the preferred section "A" and "B" displacement distance dimensions are both in a range of between 17 cm and 19 cm. The elongated longitudinal curved-shaped back support 60 in the form of an incomplete S-shape complements the vertebral column curvature of a human. Specifically, curvature area 64 complements and supports the thoracic vertebrae, and curvature area 66 complements and supports the lumbar vertebrae.

In an alternate embodiment, rear wall 24 may also include a micro massage system, not seen, comprising massage units, an operating switch, and a battery source.

Instant invention 10, and specifically padding 90 in combination with elongated longitudinal curved-shaped back support 60, alleviates the pressure upon the back of the user while bearing a load of matter carried within the instant invention 10, defined as an ergonomic backpack.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An ergonomic backpack, comprising:

A) a main compartment (20) having at least one access wall (22) that has a first substantially inverted U shape, a rear wall (24) and a base wall (38) to define a substantially hollow first cavity, said access wall (22) has a first zipper (26) as a means to access said first cavity, said rear wall (24) is a single layer rear panel;

B) an elongated longitudinal curved-shaped back support (60) interiorly mounted within said rear wall (24), having curvature areas (64) and (66) in between ends (62) and (68), said curvature area (64) complements and supports a thoracic vertebrae of a human vertebral column, and said curvature area (66) complements and supports a lumbar vertebrae of said human vertebral column;

C) padding (90) having dorsal padding (92) and lumbar padding (94) outwardly protruding from said rear wall (24) of said main compartment (20), said dorsal padding (92) and said lumbar padding (94) are ergonomically designed to contour back and shoulders of a human, said dorsal padding (92) and said lumbar padding (94) are of a sufficient predetermined thickness to dispense pressure upon said human vertebral column, said pressure resulting from a force established by a weight of matter housed within said first cavity, or otherwise secured upon said main compartment (20), said elongated longitudinal curved-shaped back support (60) located only in between pads of said dorsal padding (92) and mounted onto said rear wall (24) of the ergonomic backpack; and D) a strap assembly (100) fixedly secured to said main compartment (20), comprising shoulder straps (102), chest straps (108), and waist straps (106), said shoulder straps (102) include padding (104) that also dispenses said pressure resulting from said force, said shoulder straps (102) also have said chest straps (108) fixed thereon, said chest straps (108) may be adjusted to a center chest of said human to align said main compartment (20) with said human vertebral column, said chest straps (108) have first cooperative locking means adjustably mounted thereon to fixedly secure said chest straps (108) around said center chest of said human, said waist straps (106) have second cooperative locking means adjustably mounted thereon to fixedly secure around a waist of said human, said strap assembly (100) also dispenses said pressure resulting from said force.

2. The ergonomic backpack according to claim 1, further characterized in that said elongated longitudinal curved-shaped back support (60) defines a first predetermined displacement distance from said curvature area (64) to a first vertical plane defined from said curvature area (66), and defines a second predetermined displacement distance from said curvature area (66) to a second vertical plane defined from said curvature area (64).

3. The ergonomic backpack according to claim 2, further characterized in that said first predetermined displacement distance is in a range of between 15 cm and 19 cm.

4. The ergonomic backpack according to claim 3, further characterized in that said second predetermined displacement distance is in a range of between 17 cm and 21 cm.

5. The ergonomic backpack according to claim 4, further characterized in that said first predetermined displacement distance and said second predetermined displacement distance is in a range of between 17 cm and 19 cm.

6. The ergonomic backpack according to claim 5, further characterized in that said base wall (38) has a substantially rectangular shape and may include a semi-rigid material to serve as a structural base.

7. The ergonomic backpack according to claim 5, further characterized in that said elongated longitudinal curved-shaped back support (60) is made of a rigid material, such as plastic or PVC and covered with a soft padding-type material.

8. The ergonomic backpack according to claim 5, further characterized in that said padding (90) is made out of a soft material such as foam or a similar type material having foam-like characteristics.

9. The ergonomic backpack according to claim 5, further comprising a micro massage system having massage units, an operating switch, and a battery source.

10. The ergonomic backpack according to claim 5, further comprising a forward compartment (50) forwardly extending from said main compartment (20), said forward compartment (50) comprises an access wall (52) that has a second substantially inverted U shape and a front wall (54) to define a substantially hollow second cavity, said access wall (52) has a second zipper as a means to access said second cavity.

11. The ergonomic backpack according to claim 10, further comprising an accessory compartment (70) forwardly extending from said forward compartment (50), said accessory compartment (70) comprises an access wall (72) that has a third substantially inverted U shape and a front wall (74) to define a substantially hollow third cavity, said access wall (72) has a third zipper as a means to access said third cavity.

* * * * *